US009926834B2

(12) United States Patent
Provost

(10) Patent No.: US 9,926,834 B2
(45) Date of Patent: Mar. 27, 2018

(54) DEWATERING INTERNAL COMBUSTION ENGINE

(71) Applicant: Brian Provost, Loreauville, LA (US)

(72) Inventor: Brian Provost, Loreauville, LA (US)

( * ) Notice: Subject to any disclaimer, the term of this patent is extended or adjusted under 35 U.S.C. 154(b) by 66 days.

(21) Appl. No.: 15/062,275

(22) Filed: Mar. 7, 2016

(65) Prior Publication Data

US 2016/0222870 A1 Aug. 4, 2016

Related U.S. Application Data

(63) Continuation-in-part of application No. 13/527,734, filed on Jun. 20, 2012, now Pat. No. 9,309,854.

(51) Int. Cl.
*F01P 11/02* (2006.01)
*F02B 61/04* (2006.01)

(52) U.S. Cl.
CPC ..... *F01P 11/0276* (2013.01); *F02B 61/045* (2013.01)

(58) Field of Classification Search
CPC ..... F01P 11/0276; F02B 61/045
See application file for complete search history.

(56) References Cited

U.S. PATENT DOCUMENTS 4,674,462 A 6/1987 Koch et al.
4,676,759 A * 6/1987 Murase ..... F01P 11/0276 114/55.51
4,758,190 A * 7/1988 Van Vuren ..... F02B 61/045 440/77
4,893,594 A 1/1990 Kobayashi et al.
5,161,496 A 11/1992 Matsushima
5,201,288 A 4/1993 Doragrip
5,632,659 A * 5/1997 Martin ..... F01P 11/0276 123/198 D
6,526,938 B1 3/2003 Bysima et al.
6,676,466 B1 * 1/2004 Glen ..... F02B 61/045 440/88 R
6,914,342 B1 7/2005 French
7,066,162 B1 6/2006 Ng
7,789,074 B2 9/2010 Tashima
2003/0143902 A1 * 7/2003 McChesney ..... F02B 61/045 440/88 N

FOREIGN PATENT DOCUMENTS

JP 2005330815 12/2005

* cited by examiner

*Primary Examiner* — David Hamaoui
(74) *Attorney, Agent, or Firm* — Keaty Law Firm LLC

(57) ABSTRACT

A dewatering device for an internal combustion engine having an engine body with a lower portion, an exterior wall, and a combustion chamber formed in the engine body, the dewatering device comprising a normally closed dewatering valve detachably secured to the exterior wall, a valve activating member, and a bracket for supporting the valve activating member on the lower portion of the engine body. The dewatering valve is spring loaded and moves between a normally closed position and an open position upon operation of the valve activating member, thereby allowing evacuation of water from the combustion chamber.

15 Claims, 2 Drawing Sheets

DEWATERING INTERNAL COMBUSTION ENGINE

CROSS-REFERENCE TO RELATED APPLICATIONS

This application is a continuation-in-part of my co-pending application Ser. No. 13/527,734, filed on Jun. 20, 2012 and issued as U.S. Pat. No. 9,309,854 on Apr. 12, 2016 for a "Batteryless Engine Starting System," the full disclosure of which is incorporated by reference herein and priority of which is hereby claimed.

BACKGROUND OF THE INVENTION

This invention relates to gasoline engines, and more particularly to an internal combustion engine, which can be used in humid environment or on watercraft in such applications as, for instance, an outboard motor.

Internal combustion engines are extensively used in many industrial applications, including marine applications. The engines are designed to generate power for long periods of time on a dependable basis. Of particular concern is operation of the internal combustion engine in humid environment or where the engine is exposed to water. Sometimes, the moisture seeps into the engine block, significantly hampering performance or even rendering the entire motor useless. It is also not uncommon for an engine to become submerged under water. After submersion, the engine becomes hydrolocked, with water trapped between the piston and head in the combustion chamber. The engine becomes impossible to crank. In such cases, water must be evacuated from the engine in order to restore it to an operating condition.

Dewatering of the engine can be a lengthy process, requiring special equipment, which can be found only in professional repair shops. The present invention addresses this problem and provides a means of removing water from an engine block of an internal combustion engine in situ.

SUMMARY OF THE INVENTION

It is, therefore, an object of the present invention to provide a means of dewatering an internal combustion engine and removing moisture from an engine block.

It is another object of the present invention to provide an internal combustion engine equipped with a dewatering valve incorporated into the body of the engine block.

It is a further object of the present invention to provide a dewatering device for retrofitting internal combustion engines, which are designed to work in wet environment.

These and other objects of the invention are achieved through a provision of a dewatering device for an internal combustion engine having an engine body with a lower portion, an exterior wall, and a combustion chamber formed in the engine body. The dewatering device comprises a normally closed dewatering valve detachably threadably secured to the exterior wall, a valve activating member, and a bracket means for supporting the valve activating member on the lower portion of the engine body. The dewatering valve moves between a normally closed position and an open position upon operation of the valve activating member.

The dewatering valve comprises a valve body having an interior portion extending into the combustion chamber and an exterior portion extending outwardly from the exterior wall and provided with an exhaust port, a central bore extending though the valve body in fluid communication with the exhaust port, and a valve stem slidably movable in the central bore. The valve stem carries a frustoconical valve head on an innermost end thereof, while the valve body is provided with a matching conical valve seat. A compression spring normally urges the valve head into a closed position in engagement with the valve seat.

When the valve activating member compresses the compression spring, the valve stem is unseated, allowing water to exit the combustion chamber into the central bore and then through the exhaust port to exterior of the engine body.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
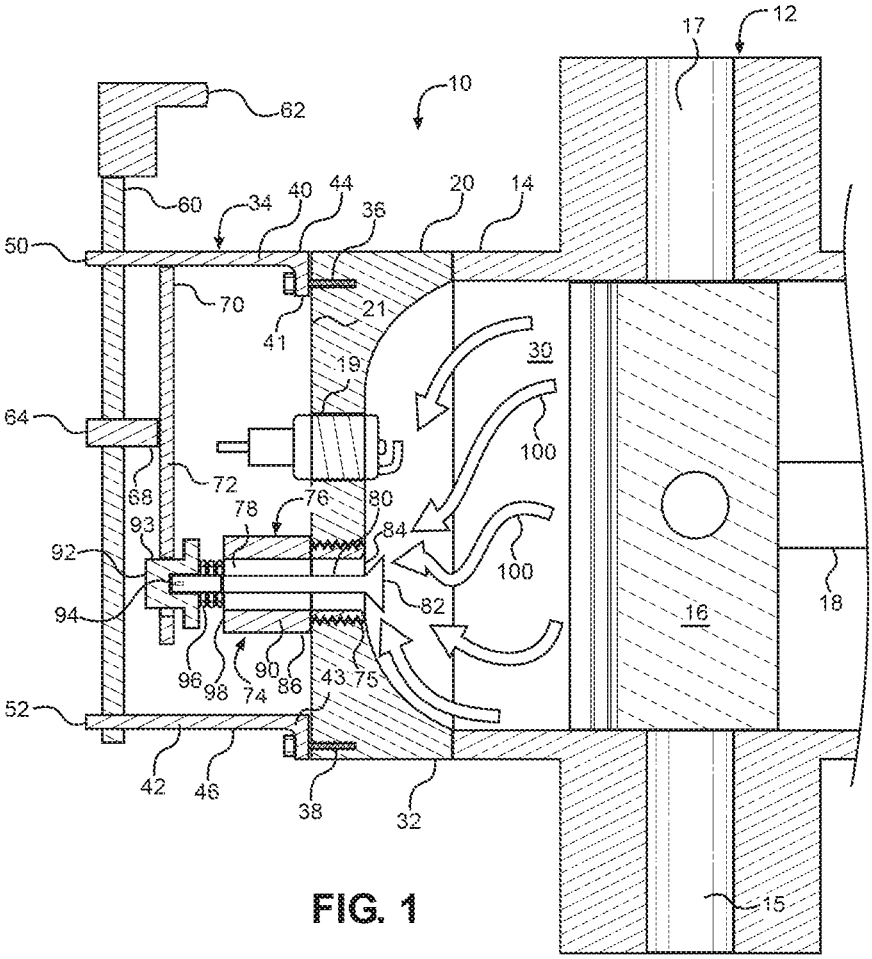
FIG. 1 is a schematic view of a portion of an internal combustion engine equipped with a dewatering device.

Turning now to FIG. 1 in more detail, numeral 10 designates the internal combustion engine with a dewatering device according to this invention. The system 10 comprises an engine 12, which can be a two-stroke internal combustion engine that can operate on heavy fuel and light fuel. For convenience of illustration, only the portion of the engine where the dewatering device is installed is shown in the drawing. It is preferred that the engine 12 be oriented upright to facilitate water evacuation, although it is envisioned that other orientations of the engine 12 are within the scope of this invention.

The engine 12 has an engine block 14, within which one or more pistons 16 reciprocate during operation of the engine. A compression rod 18 attached to the piston 16 moves the piston in a reciprocating manner. A cylinder head 20 is attached to the engine block 14 by numerous bolts or studs (not shown). The cylinder head 20 seals the engine block 14 on the side opposite to the piston 16, and contains short ducts or ports for intake and exhaust in which the intake valve is opened and closed by the piston allowing fresh air to fill the combustion chamber and in which the exhaust port is opened and closed by the position of the piston, allowing combustion gases to escape. One or more spark plugs 19 are incorporated in the cylinder head 20 and extend through a wall 21 of the engine body.

It was observed that under certain conditions, water accumulates in a combustion chamber 30 of the engine block 14. In FIG. 1, the intake port 15 and the exhaust port 17 are shown closed by a compression stroke of the piston 16, and the trapped water causing hydrolock and leaving the combustion chamber in need of water evacuation through the dewatering device only.

The device for removing the water from the combustion chamber 30 is designed as an assembly securable to the engine block 14, preferably to a lower portion 32 thereof. The dewatering device comprises a bracket means 34 mechanically attached to the wall 21 of the cylinder head 20 using a pair of threaded bolts 36, 38. The bracket means 34 comprises a pair of elongated parallel bars 40, 42, each having transverse legs 41, 43, respectively, at the proximate ends 44, 46 thereof. The transverse legs 41, 43 contact the wall 21 and are secured thereto by the bolts 36, 38, respectively.

Distant ends 50, 52 of the bracket bars 40, 42 are provided with through openings which are configured to receive a cam shaft 60. A cam actuator knob 62 is secured to an upper end of the cam shaft 60. The cam actuator knob 62 is designed to be manually operated, as will be described in more detail hereinafter.

One or more cam lobes 64 is positioned on the cam shaft 60 a distance between the bars 40, 42. The can lobe 64 has an opening, which allows the cam shaft 60 to be guided therethrough. At least a portion 68 of the cam lobe 64 extends transversely to a longitudinal axis of the cam shaft 60 to a space between the bracket bars 40, 42. An elongated valve activating bar 70 is secured to the upper bracket bar 40 and extends downwardly therefrom. The transverse portion 68 of the cam lobe 64 transmits rotation to the valve activating bar 70.

A lower end 72 of the valve activating bar or valve activating member 70 contacts a dewatering valve 74, which is detachably secured to the wall 21 of the engine block 14, partially extending into the combustion chamber 30. Threads 75 formed on at least a portion of an exterior wall of the valve body 76 allow securing of the dewatering valve 74 on the wall 21. The body 76 of the dewatering valve 74 is generally cylindrical and is provided with a central axial bore 78.

An elongated valve stem 80 is positioned in the central bore 78, slidably moving therein. The valve stem 80 is provided with a frustoconical valve head 82 on a proximate end thereof. The central bore 78 has a conical seat 84 on its inner end, which matches the angle of the valve head 82 and allows tight fitting of the valve head 82 against the conical seat 84 when the valve head is in a normally closed position. The bracket means 34 supports the valve activating bar 70 in an orientation transverse to a longitudinal axis of the valve stem.

An exterior portion 86 of the valve body 76 extends outwardly of the wall 21. The exterior portion 86 is provided with one or more exhaust ports 90, through which water is evacuated from the combustion chamber 30. The exhaust ports 90 of the exterior portion 86 of the valve body 76 are in fluid communication with the central bore 78, allowing movement of the water and air from the combustion chamber outside of the engine body.

A stem retainer cap 92 is secured to a distant end of the valve stem 80 using a cap retainer pin 94. The distant end of the valve stem 80 fits inside a machined pocket inside the stem retainer cap 92. A compression spring 96 is positioned between a distant end wall 98 of the valve body 76 and the stem retainer cap 92. The compression spring 96 fits into a machined pocket and surrounds a part of the valve stem 80, which is located between the distant end wall 98 and the stem retainer cap 92. The stem retainer cap 92 has a reduced diameter portion 93, which is acted upon by the valve activating bar 70, while receiving reciprocal motion from the cam shaft 60 via the cam lobe 64.

Normally, the compression spring 96 is in the compressed position, keeping the matching valve head 82 and the valve seat 84 pressed together making a seal. When the stem retainer/depression cap 92 is pressed on by the valve activating bar 70, the angle seats separate, opening the passage through the area between the valve seat 84 and the valve head 82.

If a motor, for instance an outboard motor, somehow becomes submerged in water, water will enter the engine and fill the crankcase and the combustion chamber 30. After recovery of the outboard motor restarting will be impossible until the water is evacuated from the engine 12. Pistons 16 with water in the combustion chamber 30 will be hydro-locked since water cannot be compressed.

The most common way of unlocking a hydro-locked outboard motor is to remove the spark plugs 19 and crank over the engine. This is a slow undesired method since spark plugs and tools can be dropped and lost, and spark plug threads in the cylinder head are commonly damaged during this process.

This problem is solved by the instant invention. The cylinder head of an outboard motor can be machined to accept the dewatering high volume valve 74 and the valve actuating assembly. This system can be operated without removing the engine cover.

Operation of the Valve System

- The operator turns the cam actuator knob 62, which in turn rotates the cam shaft 60.
- The cam shaft 60 is fitted with one or more cam lobes 64. When the cam shaft 60 is rotated, the cam lobes 64 depress the valve actuating bar 70.
- The valve actuating bar 70 then opens the dewatering valve 74, allowing water (schematically illustrated by arrows 100) to drain from the combustion chamber 30 into the opening formed between the valve head 82 and the valve seat 84.
- The combustion chamber and crankcase can be thoroughly evacuated of water by cranking the engine over rapidly, which operates the two stroke engine air flow through the intake system and crankcase and out through the exhaust port(s) 90.

The dewatering valve 74 of the present invention is installed in the lower part of the cylinder head 20, where, when opened, it drains the entire combustion chamber 30. The valve 74 is spring loaded in the closed position. When the valve stem 80 is depressed by a manual control from the outside of the engine cover, the valve head unseats and opens.

With this valve opened, the engine can be cranked slowly to force water out of the combustion chamber 30. After the majority of the water is evacuated, the crank rope (not shown) can be pulled quickly to force remaining water out of the cylinder and combustion chamber through the exhaust port(s) 90, and also vacuumed from the crankcase and forced out this way as well.

Figure 2:
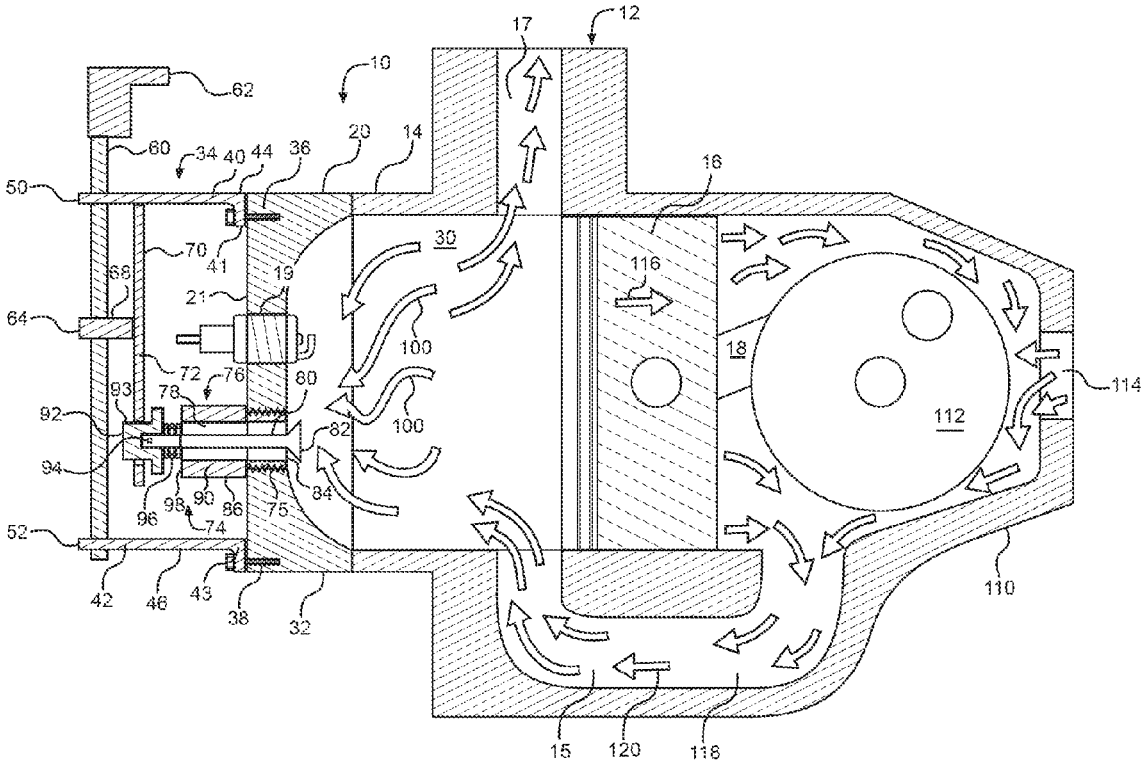
FIG. 2 illustrates the dewatering device mounted on the engine housing and water evacuation from the engine crankcase.

FIG. 2 illustrates a manner of evacuating water from the crankcase 110, where a crankshaft 112 is positioned. The crankshaft case 110 has a crankshaft air intake port 114, though which air is admitted to circulate around the crankshaft 112 inside the crankshaft chamber 118. With the hydrolock removed, the piston 16 moves away from the position obstructing the intake port 15 and the outlet port 17 in the direction of arrow 116. A fluid communication is allowed between interior of the crankshaft case 110 and the intake port 15 and the outlet port 17.

Arrows 120 illustrate the fluid flow through the crankshaft case 110 during evacuation of all water from the crankshaft case and any remaining water from the combustion chamber through the outlet port 17. Once all water is removed, the engine can be started.

It is envisioned that the instant invention can be used in conjunction with my batteryless engine starting system to restart the motor in both civilian and military operations. The internal combustion engine can be manufactured with the dewatering device installed therein, or the dewatering device can be manufactured separately as a retrofitting accessory to existing engines.

Many changes and modifications can be made in the instant invention without departing from the spirit thereof. I, therefore, pray that my rights to the present invention be limited only by the scope of the appended claims.

I claim:

1. An internal combustion engine apparatus, comprising an engine body with a lower portion of the engine body, an exterior wall, a combustion chamber formed in the engine body, and a dewatering device fitted in the exterior wall in the lower portion of the engine body, with the dewatering device operating to evacuate water collected in the combustion chamber upon demand;

wherein the dewatering device comprises a normally closed dewatering valve detachably secured to the exterior wall, a valve activating member, and a bracket means for supporting the valve activating member on the engine body, the dewatering valve moving between a normally closed position and an open position upon operation of the valve activating member; and wherein the bracket means comprises a pair of elongated parallel bars secured to the lower portion of the engine body, a cam shaft carried by the bars, and a cam actuator knob secured to an upper end of the cam shaft.

2. The apparatus of claim 1, wherein the bracket means supports the valve activating member in an orientation transverse to a longitudinal axis of the valve stem.

3. The apparatus of claim 2, the dewatering valve comprising a stem retainer cap secured to a distant end of the valve stem, and wherein the compression spring is mounted between the stem retainer cap and the exterior portion of the valve body.

4. The apparatus of claim 3, wherein the valve activating member has a lower end engaging the step retainer cap.

5. The apparatus of claim 4, wherein the cam actuator knob is manually rotatable for moving the valve activating bar and the stem retainer cap toward the valve body, thereby compressing the compression spring and opening the dewatering valve.

6. A method of dewatering an internal combustion engine, said internal combustion engine having an engine body with a lower portion of the engine body, an exterior wall, and a combustion chamber formed in the engine body, comprising the steps of securing a dewatering device in the exterior wall in the lower portion of the engine body, activating the dewatering device, and causing water collected in the combustion chamber to be removed therefrom, upon demand;

wherein the dewatering device comprises a normally closed dewatering valve detachably secured to the exterior wall, a valve activating member, and a bracket means for supporting the valve activating member on the engine body, the dewatering valve moving between a normally closed position and an open position upon operation of the valve activating member;

wherein said dewatering valve further comprises a valve body having an interior portion extending into the combustion chamber and an exterior portion extending outwardly from the exterior wall and provided with an exhaust port, a central bore extending through the valve body in fluid communication with the exhaust port, a valve stem slidably movable in the central bore, the valve stem carrying a valve head on an innermost end thereof, and a compression spring normally urging the valve head into a close position in engagement with a valve seat formed by the interior portion of the valve body; and wherein the bracket means comprises a pair of elongated parallel bars secured to the lower portion of the engine body, a cam shaft carried by the bars, and a cam actuator knob secured to an upper end of the cam shaft.

7. The method of claim 6, wherein the bracket means supports the valve activating member in an orientation transverse to a longitudinal axis of the valve stem.

8. The method of claim 7, comprising a step of providing the dewatering valve with a stem retainer cap, securing the stem retainer cap to a distant end of the valve stem, and wherein the compression spring is mounted between the stem retainer cap and the exterior portion of the valve body.

9. The method of claim 7, comprising a step of engaging a lower end of the valve activating member with the retainer cap.

10. The method of claim 9, comprising a step of rotating the cam actuator knob, thereby causing movement of the valve activating member and the retainer cap against the compression spring, thereby forcing slidable movement of the valve stem away from the valve seat, and thereby allowing water to exit the compression chamber through the central bore and the exhaust port.

11. A dewatering device for an internal combustion engine having an engine body with a lower portion of the engine body, an exterior wall, and a combustion chamber formed in the engine body, the dewatering device comprising a normally closed dewatering valve detachably secured to the exterior wall, a valve activating member, and a bracket means for supporting the valve activating member on the lower portion of the engine body, the dewatering valve moving between a normally closed position and an open position upon operation of the valve activating member;

wherein said dewatering valve further comprises a valve body having an interior portion extending into the combustion chamber and an exterior portion extending outwardly from the exterior wall and provided with an exhaust port, a central bore extending through the valve body in fluid communication with the exhaust port, a valve stem slidably movable in the central bore, the valve stem carrying a valve head on an innermost end thereof, and a compression spring normally urging the valve head into a closed position in engagement with a valve seat formed by the interior portion of the valve body; and wherein the bracket means comprises a pair of elongated parallel bars secured to the lower portion of the engine body, a cam shaft carried by the bars, and a cam actuator knob secured to an upper end of the cam shaft.

12. The device of claim 11, wherein the bracket means supports the valve activating member in an orientation transverse to a longitudinal axis of the valve stem.

13. The device of claim 11, the dewatering valve comprising a stem retainer cap secured to a distant end of the valve stem, and wherein the compression spring is mounted between the stem retainer cap and the exterior portion of the valve body.

14. The device of claim 13, wherein the valve activating member has a lower end engaging the step retainer cap.

15. The device of claim 14, wherein the cam actuator knob is manually rotatable for moving the valve activating bar and the stem retainer cap toward the valve body, thereby compressing the compression spring and opening the dewatering valve.

* * * * *